US007360760B2

(12) United States Patent
Lin

(10) Patent No.: US 7,360,760 B2
(45) Date of Patent: Apr. 22, 2008

(54) PAPER TRAY AND METHOD FOR USING THE SAME

(75) Inventor: Nien-Chin Lin, Shulin (TW)

(73) Assignee: BENQ Corporation, Taoyuan (TW)

( * ) Notice: Subject to any disclaimer, the term of this patent is extended or adjusted under 35 U.S.C. 154(b) by 385 days.

(21) Appl. No.: 11/089,313

(22) Filed: Mar. 24, 2005

(65) Prior Publication Data

US 2005/0230903 A1 Oct. 20, 2005

(30) Foreign Application Priority Data

Apr. 1, 2004 (TW) ..... 93109044 A

(51) Int. Cl.
*B65H 1/00* (2006.01)

(52) U.S. Cl. ..... 271/162; 271/145; 271/164

(58) Field of Classification Search ..... 271/145, 271/162, 163, 164, 171; 109/47; 902/13
See application file for complete search history.

(56) References Cited

U.S. PATENT DOCUMENTS

| | | | | |
|---|---|---|---|---|
| 4,504,053 | A | 3/1985 | Shiozawa | |
| 5,785,308 | A * | 7/1998 | Flores et al. | 271/9.11 |
| 5,897,112 | A * | 4/1999 | Kwag | 271/38 |
| 7,097,172 | B2 * | 8/2006 | Chang | 271/171 |
| 2002/0164190 | A1 | 11/2002 | Hill | |
| 2004/0051233 | A1 | 3/2004 | Jeong et al. | |

FOREIGN PATENT DOCUMENTS

| | | |
|---|---|---|
| DE | 9216283 | 12/1992 |
| JP | 580222223 | 2/1983 |
| JP | 62225378 | 10/1987 |

OTHER PUBLICATIONS

German Office Action mailed May 15, 2006.

* cited by examiner

*Primary Examiner*—Patrick Mackey
*Assistant Examiner*—Howard Sanders
(74) *Attorney, Agent, or Firm*—Thomas, Kayden, Horstemeyer & Risley

(57) ABSTRACT

A paper tray for use with a printer. The paper tray includes a sidewall, a door plate, a rotating member and a resilient element. The sidewall has a through hole. The door plate pivots on the sidewall and rotates around an X-axis. The rotating member is disposed in the through hole and pivots on the sidewall. The rotating member has an engagement portion and selectively rotates between a first position and a second position around a Y-axis. The resilient element is disposed between the rotating member and the sidewall, providing resilience to the rotating member to rotate to the first position. The rotating member rotates to the second position when exerted to overcome the resilience. The rotating member rotates to the first position by the resilience in the absence of external pressure, such that the engagement portion abuts the door plate.

8 Claims, 8 Drawing Sheets

PAPER TRAY AND METHOD FOR USING THE SAME

BACKGROUND OF THE INVENTION

1. Field of the Invention

The present invention relates to a paper tray, and in particular to a paper tray that is easily locked and opened.

2. Description of the Related Art

A printer is generally deployed with a paper tray, usually formed with a primary feeding portion and a secondary feeding portion. In order to minimize printer dimensions, the primary and secondary feeding portions are combined. When the paper tray is removed from the printer, the secondary feeding portion can serve as a handle for the paper tray. When the paper tray is in the printer, the secondary feeding portion can open and support media sheets. Accordingly, when the secondary feeding portion serves as a handle, fixing force provided thereby must be sufficient to allow the paper tray to be easily removed. The paper tray accordingly has locking and opening mechanisms. Namely, when the paper tray is removed from the printer, the secondary feeding portion can serve as a stable handle by operation of the locking mechanism. When the paper tray is in the printer, the secondary feeding portion can open and support media sheets by operation of the opening mechanism.

The locking and opening mechanisms, however, create difficulty of manufacture for the paper tray, increasing the number of elements and manufacturing costs thereof.

Hence, there is a need for an improved paper tray that combines the locking and opening mechanisms, allowing the secondary feeding portion of the paper tray to be easily locked and opened.

SUMMARY OF THE INVENTION

Accordingly, an object of the invention is to provide a paper tray for use with a printer. The paper tray comprises a sidewall, a door plate, a rotating member and a resilient element. The sidewall is formed with a through hole. The door plate pivots on the sidewall and rotates around an X-axis. The rotating member is disposed in the through hole and pivots on the sidewall. The rotating member has an engagement portion and selectively rotates between a first position and a second position around a Y-axis. A predetermined included angle exists between the X-axis and the Y-axis. The resilient element is disposed between the rotating member and the sidewall, providing resilience to the rotating member to rotate to the first position. The rotating member rotates to the second position when exerted to overcome the resilience. The rotating member rotates to the first position by the resilience in the absence of external pressure, such that the engagement portion abuts the door plate and the door plate cannot rotate.

The engagement portion of the rotating member further comprises a first curved surface and a second curved surface. The door plate slides on the first curved surface to rotate from a locked position to an open position. The door plate slides on the edge of the second curved surface and on the first curved surface to rotate from the open position to the locked position.

The resilient element is a torsion spring.

The paper tray further comprises a fixed pin fit in the torsion spring. Two ends of the torsion spring are connected to the rotating member and sidewall, respectively.

The paper tray further comprises a primary feeding portion and a secondary feeding portion. The printer has a media intake. The secondary feeding portion is between the primary feeding portion and the door plate. Two output retardant plates of the secondary and primary feeding portions are adjacent to each other and correspond to the media intake of the printer.

Another object of the invention is to provide a method of attachment and detachment of paper tray. The method comprises the steps of providing a paper tray comprising a door plate and a rotating member, pushing the paper tray into the printer, wherein the rotating member rotates around a Y-axis to a third position to abut the door plate by abutting a protrusion of the printer, rotating the door plate around an X-axis such that the door plate pushes the rotating member to a second position and is not limited by the rotating member, wherein a predetermined included angle exists between the X-axis and the Y-axis, and removing the paper tray from the printer such that the rotating member is separated from the protrusion and rotates from the third position to a first position to abut the door plate.

Accordingly, the method of attachment and detachment of paper tray further comprises a step of providing a resilient element to connect the rotating member. The resilient element provides resilience to rotate the rotating member to the first position.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
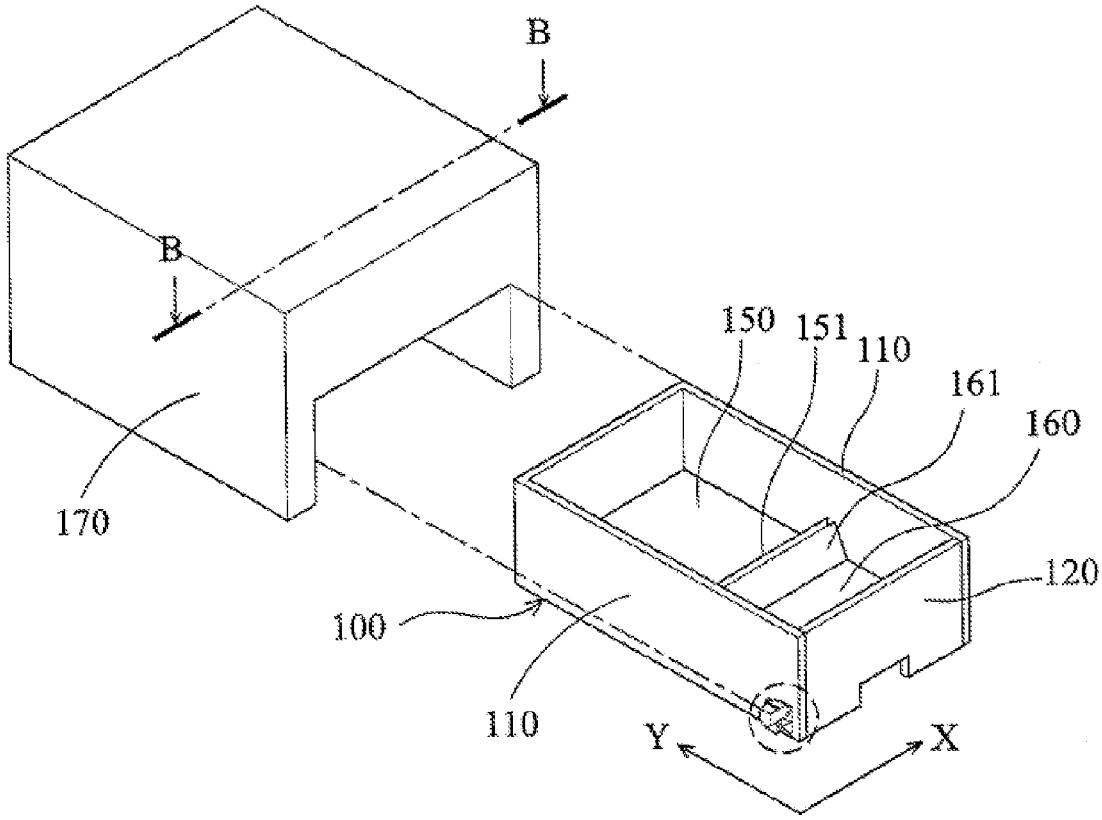
FIG. 1 is a schematic perspective view of a printer and the paper tray of the invention, wherein the paper tray is in a locked condition.
Figure 1:
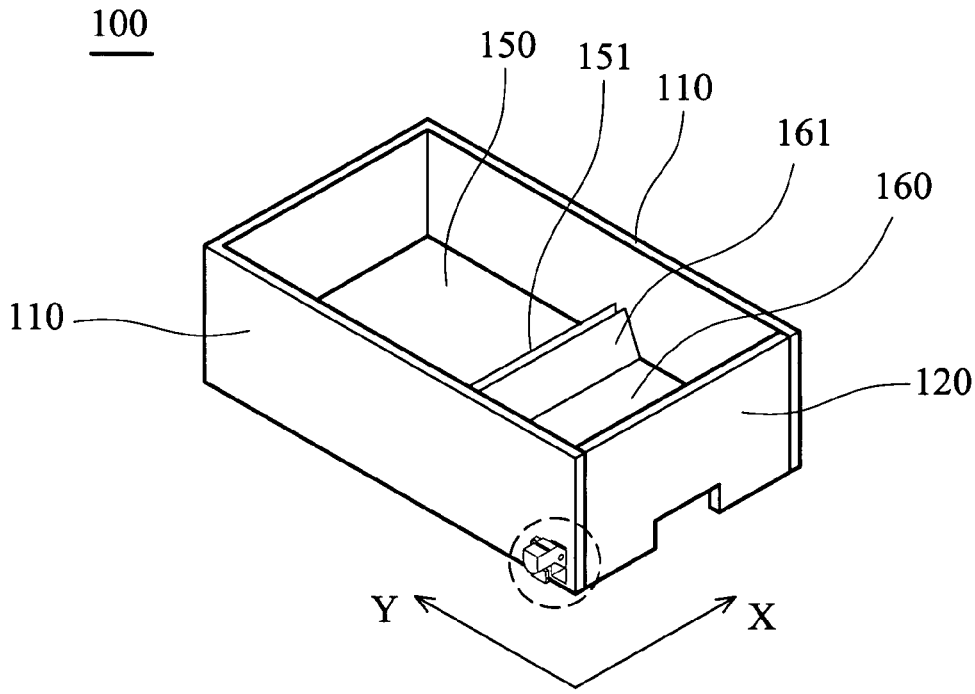
Figure 2:
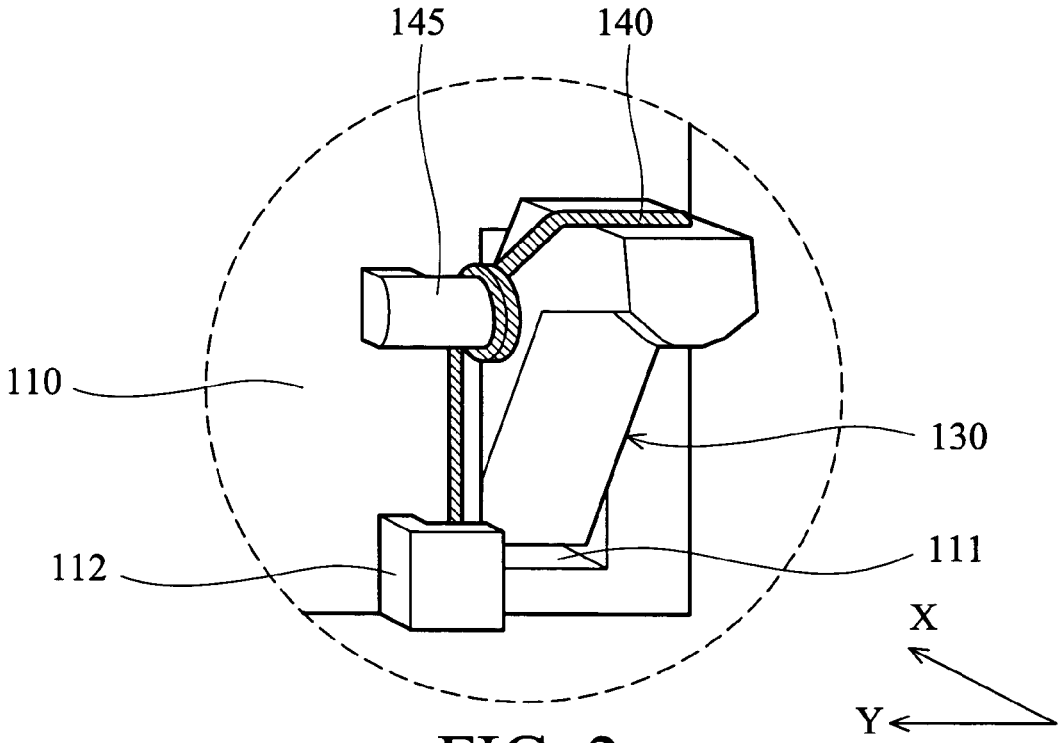
FIG. 2 is a partial enlarged view according to FIG. 1.

Referring to FIG. 1 and FIG. 2, the paper tray 100 for use in a printer 170 comprises two sidewalls 110, a door plate 120, a rotating member 130, a resilient element 140, a fixed pin 145, a primary feeding portion 150 and a secondary feeding portion 160.

As shown in FIG. 1 the secondary feeding portion 160 is between the primary feeding portion 150 and the door plate 120. Media sheets are placed in the primary feeding portion 150 and secondary feeding portion 160. Additionally, the printer 170 has a media intake (not shown). The secondary feeding portion 160 and primary feeding portion 150 have an output retardant plate 161 and an output retardant plate 151, respectively. The output retardant plates 161 and 151 are adjacent to each other. When the paper tray 100 is in the printer 170, the output retardant plates 161 and 151 correspond to the media intake of the printer 170.

Figure 6:
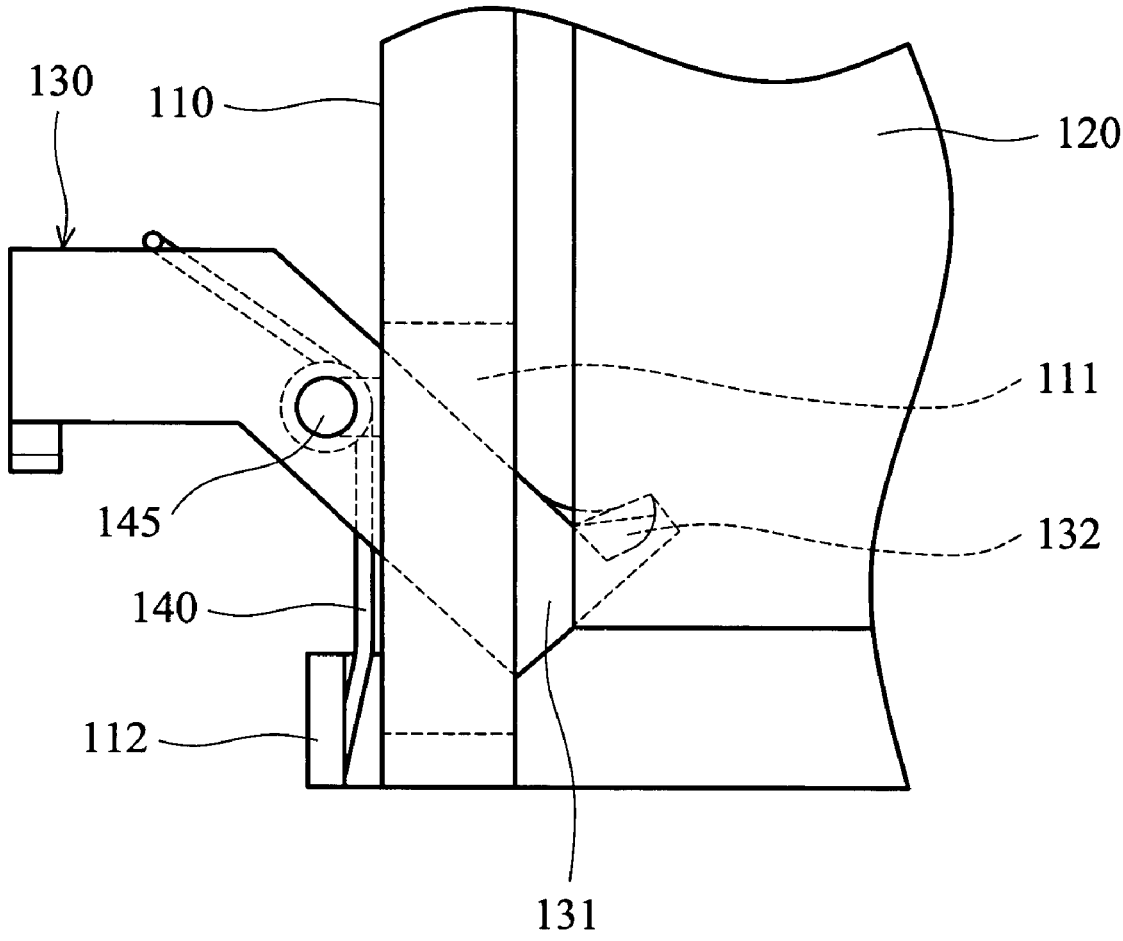
FIG. 6 is a schematic plane view of the rotating member of the paper tray of the invention in a first position.

As shown in FIG. 2, a through hole 111 is formed on one of the sidewalls 110. The door plate 120 pivots on the sidewall 110 and rotates around an X-axis. The fixed pin 145 is disposed on the sidewall 110 and above the through hole 111. The rotating member 130 is disposed in the through hole 111 and pivots on the sidewall 110. Specifically, the rotating member 130 is rotatably disposed on the fixed pin 145, such that the rotating member 130 can selectively rotate between a first position (as shown in FIG. 6) and a second position (as shown in FIG. 4B) around a Y-axis. The door plate 120 is locked in the first position and open in the second position. A predetermined included angle exists between the X-axis and the Y-axis, preferably 90°. The resilient element 140 is a torsion spring disposed between the rotating member 130 and the sidewall 110, providing resilience to the rotating member 130 to rotate to the first position. The fixed pin 145 is fit in the resilient element (torsion spring) 140, and two ends of the resilient element (torsion spring) 140 are respectively connected to the rotating member 130 and a fixing portion 112 of the sidewall 110.

Figure 3A:
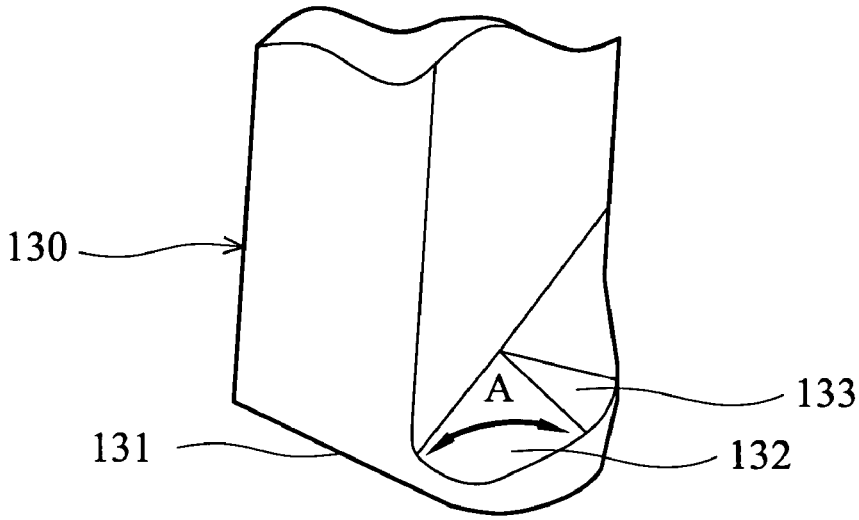
FIG. 3A is a partial perspective view of the rotating member of the paper tray of the invention.
Figure 3B:
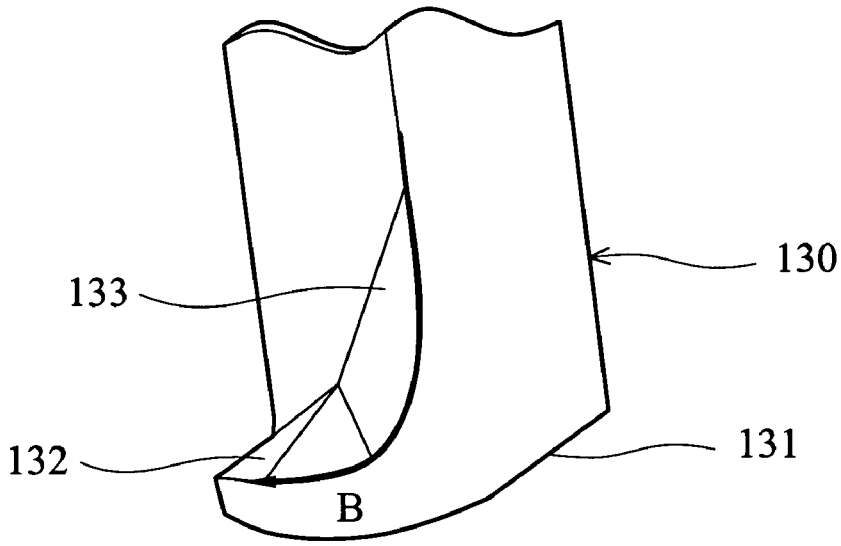
FIG. 3B is another partial perspective view of the rotating member of the paper tray of the invention.

Referring to FIG. 3A and FIG. 3B, the rotating member 130 has an engagement portion 131, and the engagement portion 131 has a first curved surface 132 and a second curved surface 133.

The following description explains the method for use of the paper tray 100.

Figure 4A:
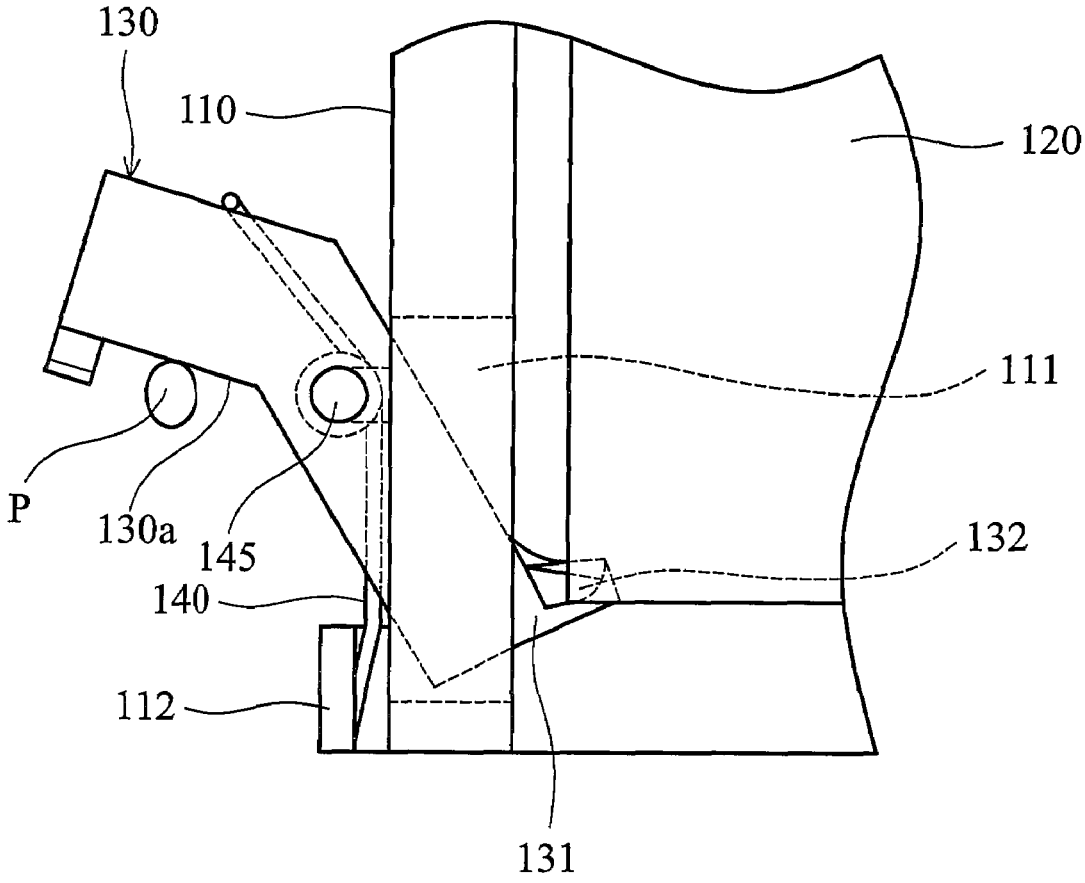
FIG. 4A is a schematic plane view of the rotating member of the paper tray of the invention in a third position.
Figure 4B:
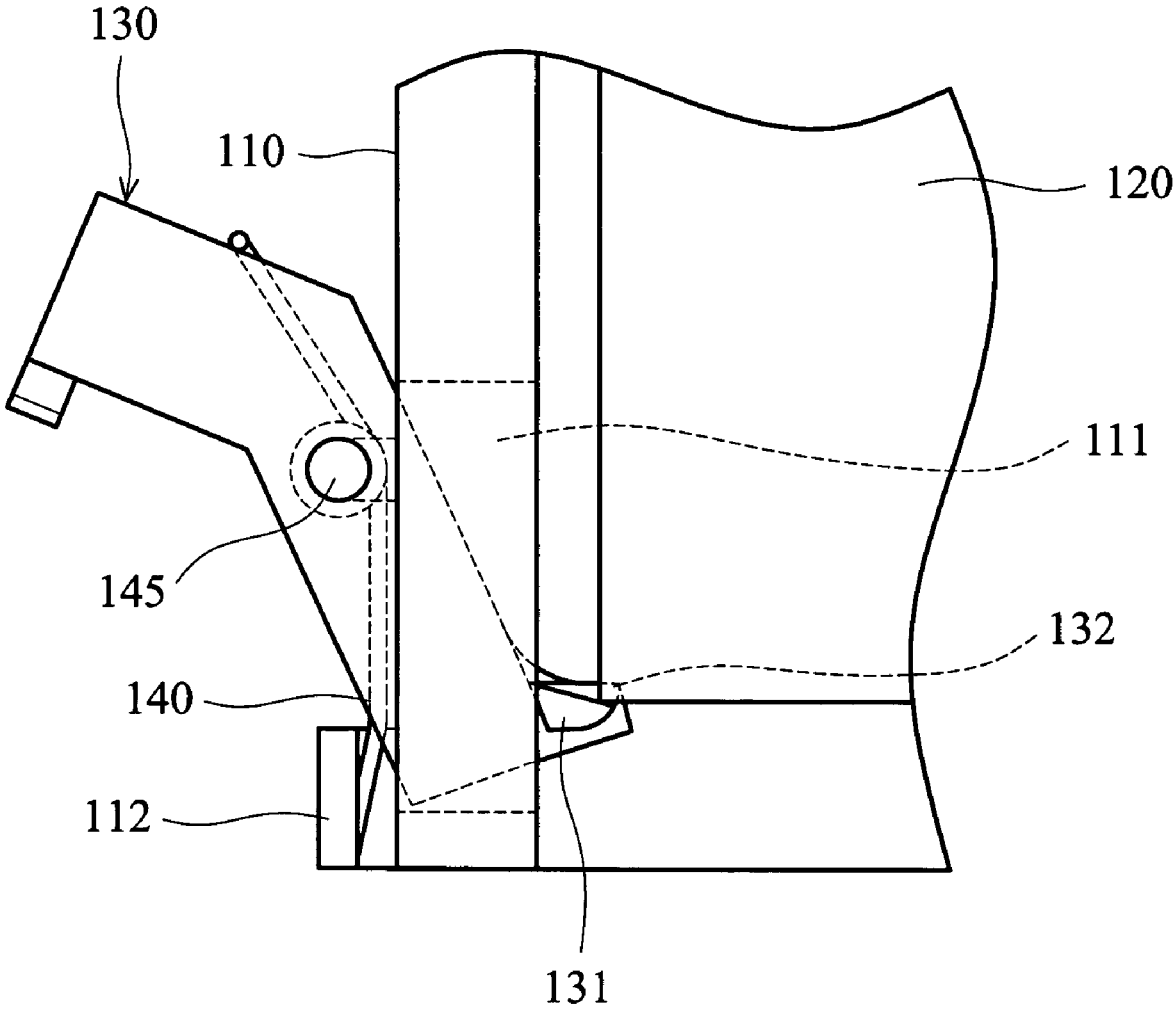
FIG. 4B is a schematic plane view of the rotating member of the paper tray of the invention in a second position.
Figure 5:
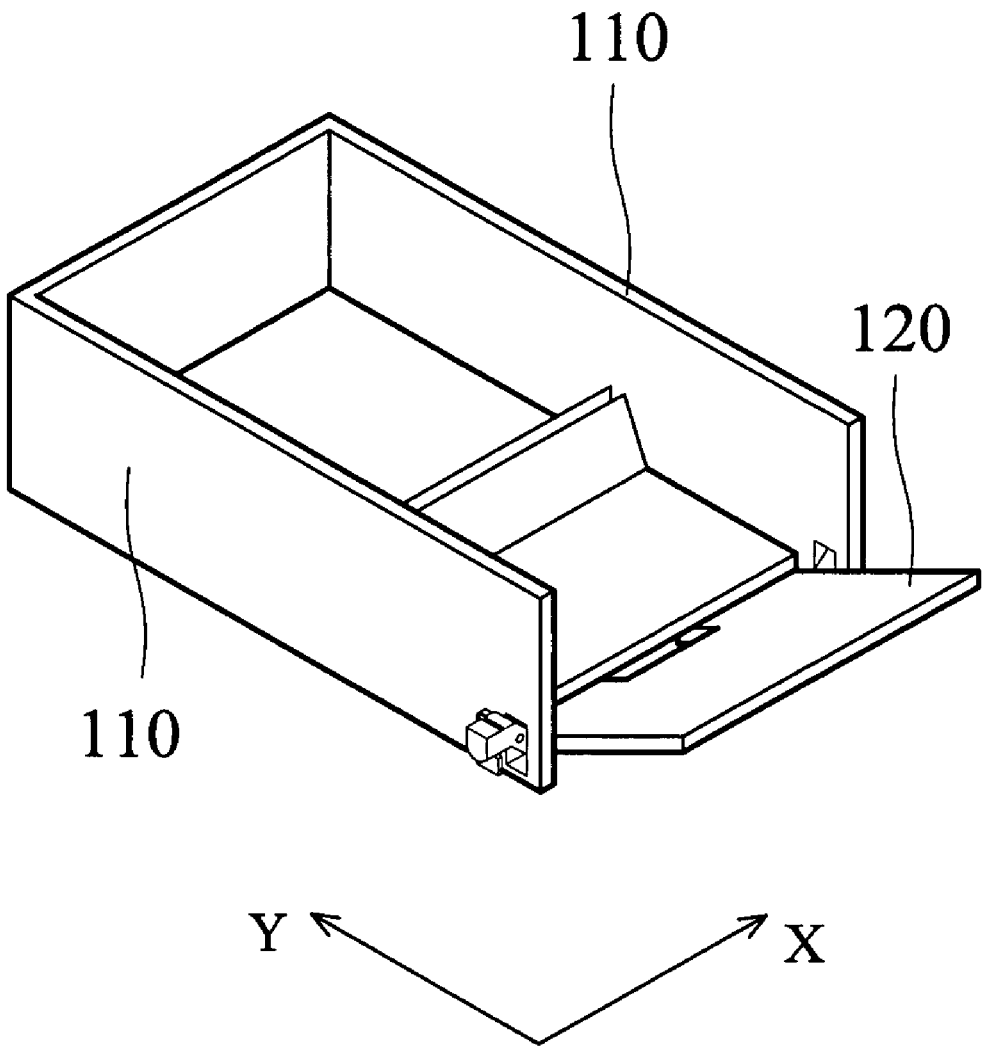
FIG. 5 is a schematic perspective view of the paper tray of the invention in an open condition.
Figure 7C:
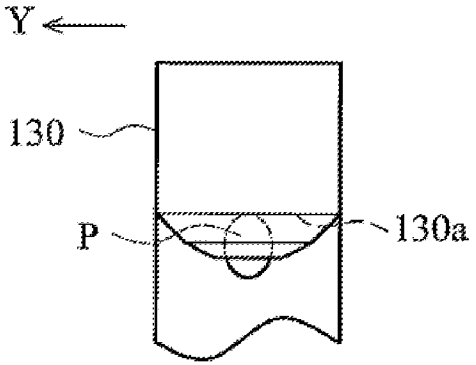
FIGS. 7A-7C are schematic views showing the relationship between the rotating member and a protrusion of the printer.
Figure 7B:
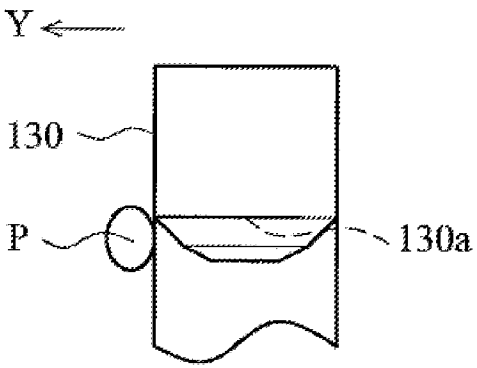
Figure 7A:
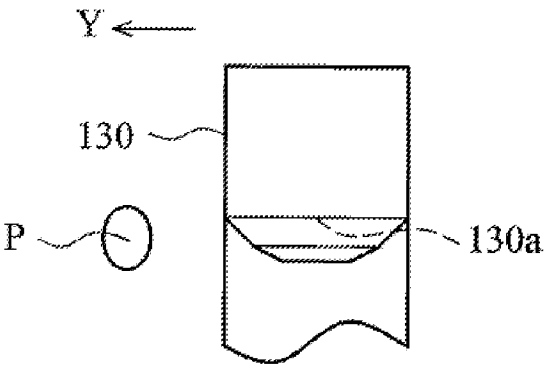

As shown in FIG. 1 and FIG. 4A, the paper tray 100 is inserted into the printer 170 and the rotating member 130 thereof rotates to a third position (as shown in FIG. 4A) around the Y-axis by abutting a protrusion P of the printer 170 at an abutting surface 130*a*. Specifically, before the rotating member 130 abuts the protrusion P, the relationship between the rotating member 130 and the protrusion P is shown in FIG. 7A. The abutting surface 130*a* is lower than a top end of the protrusion P. After the rotating member 130 moves along the Y-axis and abuts the protrusion P as shown in FIG. 7B, the abutting surface 130*a* of the rotating member 130 moves along the peripheral of the protrusion P while the whole rotating member 130 rotates around the Y-axis. When the paper tray 110 is moved to a position where the rotating member 130 is located at a position as shown in FIG. 7C, the rotating member 130 rotates to the third position as shown in FIG. 4A. At this point, the engagement portion 131 abuts the door plate 120. The protrusion P of the printer 170 abutting the rotating member 130 overcomes the resilience provided by the resilient element 140 to rotate the rotating member 130 to the third position. At this point, the first curved surface 132 of the engagement portion 131 of the rotating member 130 contacts the door plate 120. Specifically, the third position is between the first and second positions. The door plate 120 is then rotated (pulled) toward the exterior of the paper tray 100 and around the X-axis, such that the door plate 120 slides on the first curved surface 132 of the engagement portion 131 (as shown by route A in FIG. 3A). Again, the rotating member 130 rotates around the Y-axis. As shown in FIG. 3A and FIG. 4B, the door plate 120 continues rotating until reaching the second position and sliding across the edge of the second curved surface 133 of the engagement portion 131. The door plate 120 is then separated from the rotating member 130 and is not further limited thereby. At this point, the door plate 120 is in an open position and can support the media sheets. Namely, the paper tray 100 is in an open condition, as shown in FIG. 5.

The door plate 120 can also rotate toward the interior of the paper tray 100 and around the X-axis, such that the rotating member 130 rotates around the Y-axis again. Specifically, the door plate 120 sequentially slides across the edge of the second curved surface 133 of the engagement portion 131 (as shown by route B in FIG. 3B) and first curved surface 132 thereof (as shown by route A in FIG. 3A). At this point, the door plate 120 returns to the position as shown in FIG. 4A and is in a locked position. Namely, the paper tray 100 is in a closed condition, as shown in FIG. 1.

Moreover, when the paper tray 100 is removed from the printer 170, the rotating member 130 is no longer abutted by the protrusion P of the printer 170 and immediately rotates from the third position to the first position by the resilience provided by the resilient element 140, as shown in FIG. 6. At this point, the engagement portion 131 of the rotating member 130 abuts the door plate 120 and the door plate 120 cannot rotate. The door plate 120 can thus serve as a handle to remove the paper tray 100 from the printer 170.

Although the paper tray 100 of this embodiment is described with a sidewall 110, a rotating member 130, a resilient element 140 and a fixed pin 145, the paper tray of the invention can also employ two rotating members 130, two resilient elements 140 and two fixed pins 145 disposed on the opposite sidewalls 110 to achieve the aforementioned effect.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for using a paper tray comprising a sidewall, a rotating member and a resilient element, the sidewall comprising a through hole, the door plate pivotally connected on the sidewall, the rotating member disposed in the through hole and comprising an engagement portion, the engagement portion comprising a first curved surface and a second curved surface, the resilient element disposed between the rotating member and the sidewall, comprising the steps of:

inserting the paper tray into a printer, wherein the rotating member rotates around a Y-axis by abutment with the printer, and the first curved surface of the engagement portion contacts the door plate;

rotating the door plate toward the exterior of the paper tray and around an X-axis, such that the door plate slides on the first curved surface of the engagement portion and the rotating member rotates around the Y-axis to allow the door plate to slide across the edge of the second curved surface and separate from the rotating member, wherein a predetermined included angle exists between the X-axis and the Y-axis; and rotating the door plate toward the interior of the paper tray and around the X-axis, such that the rotating member rotates around the Y-axis to allow the door plate to sequentially slide across the edge of the second curved surface and across the first curved surface.

2. A method for using a paper tray in a printer, comprising the steps of:

providing a paper tray comprising a door plate and a rotating member;

inserting the paper tray into the printer to allow a protrusion of the printer abut the rotating member to make the rotating member rotate around a Y-axis to a third position to abut the door plate;

pulling the door plate to make the door plate rotate around an X-axis such that the door plate pushes the rotating member to a second position when the door plate is rotated, wherein a predetermined included angle exists between the X-axis and the Y-axis; and removing the paper tray from the printer such that the rotating member is away from the protrusion of the printer, so the rotating member is capable of rotating from the third position to a first position, and the rotating member prevents the door plate from rotating when the rotating member is positioned in the first position.

3. The method as claimed in claim 2, further comprising a step of:

providing a resilient element connected to the rotating member, wherein the resilient element provides resilience to rotate the rotating member to the first position.

4. A printer, comprising:

a protrusion; and a paper tray detachably connected to the printer, wherein the paper tray comprises:

a sidewall, with a through hole;

a door plate pivotally connected on the sidewall and rotatable around an X-axis;

a rotating member having an engagement portion, the rotating member being disposed in the through hole and pivotally connected on the sidewall, the rotating member rotatable around a Y-axis between a first position and a second position, and a predetermined included angle exists between the X-axis and the Y-axis; and a resilient element disposed between the rotating member and the sidewall, providing resilience to make the rotating member to be positioned at the first position, wherein the protrusion abuts the rotating member to overcome the resilience to make the rotating member rotate to a third position when the paper tray is connected to the printer, the rotating member rotates to the first position by the resilience when the paper tray is removed from the printer, such that the engagement portion abuts the door plate to prevent the door plate from rotating when the rotating member is at the first position, and the third position is between the first position and the second position.

5. The printer as claimed in claim 4, wherein the engagement portion of the rotating member further comprises a first curved surface and a second curved surface, the door plate slides on the first curved surface to rotate from a locked position to an open position, and the door plate slides on the edge of the second curved surface and on the first curved surface to rotate from the open position to the locked position.

6. The printer as claimed in claim 4, wherein the resilient element is a torsion spring.

7. The printer as claimed in claim 6, further comprising a fixed pin fit in the torsion spring, wherein two ends of the torsion spring are connected to the rotating member and sidewall, respectively.

8. The printer as claimed in claim 4, further comprising a media intake, wherein the paper tray further comprises a primary feeding portion and a secondary feeding portion, the secondary feeding portion is between the primary feeding portion and the door plate, and two output retardant plates of the secondary and primary feeding portions are adjacent to each other and correspond to the media intake.

* * * * *